United States Patent [19]

Perini

[11] 4,329,895

[45] May 18, 1982

[54] MACHINE FOR CUTTING SIMULTANEOUSLY ONE OR MORE ROLLS OR STICKS OF PAPER TO OBTAIN A PLURALITY OF SMALL ROLLS

[76] Inventor: Guglielmo Perini, Via delle Cartiere, Botticino, Lucca, Italy

[21] Appl. No.: 142,148

[22] Filed: Apr. 21, 1980

[51] Int. Cl.[3] ..... B26D 1/03; B26D 3/16; B26D 7/12

[52] U.S. Cl. ..... 83/174; 83/409; 83/411 R; 83/425.3; 83/431; 83/435.2

[58] Field of Search ..... 83/174, 425.3, 409, 83/411 R, 431, 435.2

[56] References Cited

U.S. PATENT DOCUMENTS

| | | | |
|---|---|---|---|
| 995,491 | 6/1911 | Smythe | 83/431 |
| 2,535,261 | 12/1950 | Brown | 83/435.2 |
| 3,288,009 | 11/1966 | Bradley | 83/409 |
| 3,369,582 | 2/1968 | Giangiulio | 83/425.3 |
| 3,538,802 | 11/1970 | Helm et al. | 83/411 R |
| 4,184,397 | 1/1980 | Jones | 83/425.3 |
| 4,254,678 | 3/1981 | Steiner et al. | 83/425.3 |

*Primary Examiner*—Donald R. Schran
*Attorney, Agent, or Firm*—McGlew and Tuttle

[57] ABSTRACT

A machine for cutting an elongated paper roll to be cut into a plurality of smaller rolls includes parallel cutting blades and a roll transporting unit with a feedpath inclined relative to the cutting edge of each blade so that the blades penetrate and progressively cut a roll as it is advanced through the feedpath.

6 Claims, 5 Drawing Figures

MACHINE FOR CUTTING SIMULTANEOUSLY ONE OR MORE ROLLS OR STICKS OF PAPER TO OBTAIN A PLURALITY OF SMALL ROLLS

FIELD AND BACKGROUND OF THE INVENTION

The invention relates a machine for cutting a stick or roll of paper into a plurality of small rolls. An example of application of said machine is that of producing rolls of toilet paper.

SUMMARY OF THE INVENTION

In accordance with the invention a machine of high production, of limited overall dimensions and of substantial simplicity of structure is provided.

According to the invention, the machine comprises: a plurality of fixed thin blades, lying on planes parallel to each other; a roll transporting unit having an active path which is inclined relative to the cutting edge of the blades to obtain the penetration and progressive cut of the blades in at least one roll during the advance along said active path; and means for feeding the rolls or sticks to be cut and to discharge the small rolls obtained.

The transporting unit can comprise continuous flexible elements, adapted for continuous or intermittent motion, and at least one roll-holder with at least one seat for a roll to be cut.

The one or more roll-holders advantageously comprises two contiguous seats for two rolls to be cut simultaneously, and there are then provided two contiguous feeders to supply a pair of rolls each time.

A roll-holder is formed as a trough with spaced slits corresponding to the blades, so that the blades enter and are guided in the advance along the active path.

The machine also, advantageously, comprises blade sharpening means which are operable for a blade sharpening and return cycle during the second part of a cutting stroke and during the discharge phase.

BRIEF DESCRIPTION OF THE DRAWINGS

The invention will be better understood following the description and the attached drawings, which shows a practical non-limiting exemplification of the invention.

In the drawings.

DETAILED DESCRIPTION OF THE PREFERRED EMBODIMENTS

Figure 1:
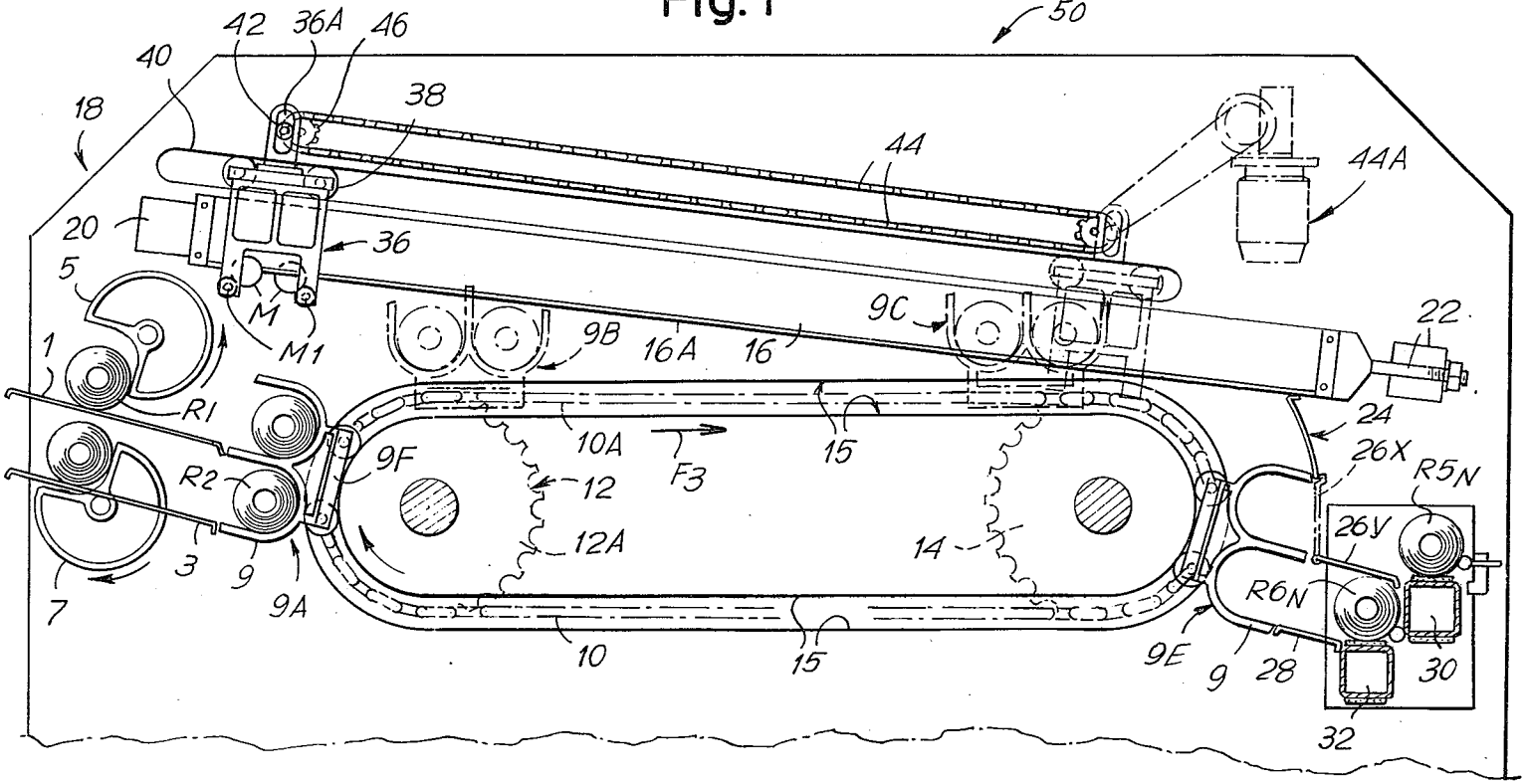
FIG. 1, illustrates a schematic longitudinal section of the embodiment of the invention.
Figure 2:
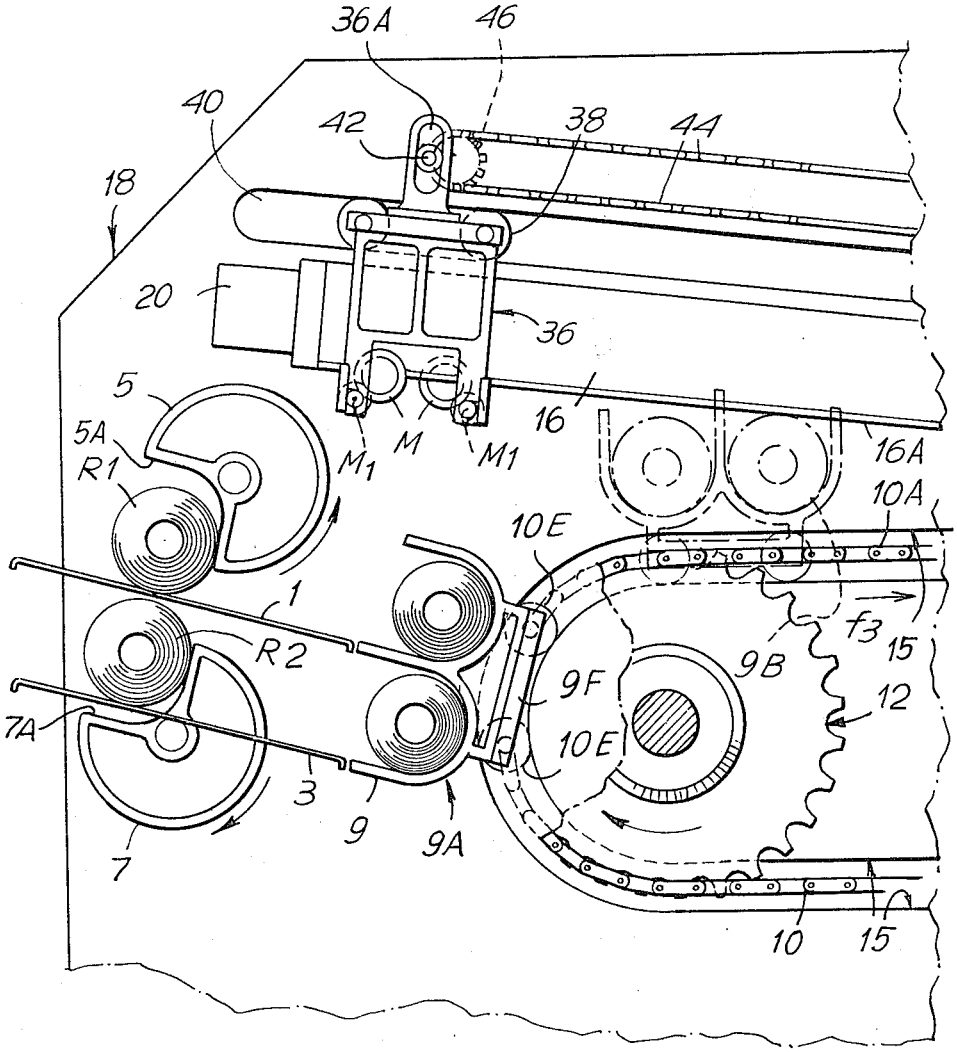
FIG. 2 illustrates an enlarged view of the left side of FIG. 1.

Referring now to the drawings wherein like reference numerals designate like or corresponding parts throughout the several views, there is shown a cutting machine, generally indicated at 50 have two inclined planar chutes 1, 3 for passing elongated feed rolls R1 and R2 to be cut. Two circular workpiece holding devices or feeders 5, 7, each associated with a respective one of the chutes 1, 3, include a respective surface sector 5A, 7A to hold the feed rolls. The feeders 5, 7 are adapted to be rotated and are operable for supplying one of the feed rolls R1, R2 to a roll-holder 9 while retaining other feed rolls. The roll-holder 9 includes two contiguous seats for receiving the two rolls to be cut simultaneously.

As shown in FIG. 1, each of the seats is arranged normally to the feedpath and is provided with an arcuate seating surface conforming to the circumference of the elongated paper rolls to be cut.

The feed rolls are received by a roll-holder 9 which has two longitudinal seats in the form of a trough, that is, forked, aligned in position 9A with the chutes 1 and 3. A continuous transport or handling system 10, such as a continuous or endless chain or the like, extending substantially beneath the feedpath, driven through transmission means 12 and 14, carries the roll-holder 9, or several roll-holders, distributed along the handling system 10 and draws the roll-holder 9, successively into various positions with an intermittent or continuous movement through a feedpath. Each roll-holder 9 includes a pair of rollers 10E mounted to and guided by tracks 15 in which the rollers 10E run. One of the positions reached by the roll-holder is that mentioned above indicated by 9A for the reception of the rolls from position in the feeders 5, 7 to position 9A in the roll holder 9. The active branch of the transport system 10, which can be horizontal or nearly horizontal, is slightly inclined relative to a cutting edge 16A of a plurality of spaced blades 16 side by side, which are mounted side by side, on a frame 18 with fixed supports 20 and supports 22 for holding the blades tight. Between the cutting edge 16A of the blades and the upper active path 10A of the transport system 10, and hence of the roll-holder element or elements 9, there is an inclination such that in a position 9B of element 9 the cutting of the rolls carried by element 9 begins while upon reaching position 9C at the end of the active stroke, the rolls R have been cut into a plurality of small rolls $R_N$ having a length corresponding to the interspace between the blades. The cut occurs due to the displacement of the rolls and of element 9 throgh a conveying path according to the arrow F3, and by the progressive penetration of the blades into the paper rolls as a result of the inclination of the blades relative to the active path 10A.

At a position 9E of the roll-holder 9 the small rolls $R_N$, obtained by the cutting by action of the multiple blades 16 are discharged. At position 9E, located at the transmission means 14, a roll-holder element 9 is inclined slightly outward and downward to allow the spontaneous discharge of the small rolls. The small rolls are retained in the trough of the roll-holder 9 by a wall 24 during the final path to reach the position 9E; the small rolls which are present in the lower seat in position 9E are further retained after the wall 24 by a movable wall 26, which is articulated at a pivot 29, and which descends from the roll-retaining position 26X to the chute position 26Y for passing or rolling of the upper small rolls, to a chute surface 26 parallel to a chute surface 28 for the rolling of the lower small rolls. The two rolling chute surfaces 26 and 28 permit the small rolls obtained to pass to positions $R5_N$ and $R6_N$ on conveyors 30 and 32 which remove them for example with a displacement parallel to the axis of the small rolls. The end scraps $R_S$ at the respective ends of a cut roll can easily be eliminated.

The continuous conveyor 10 comprises a pair of chains 10B which are driven by the systems 12 and 14, the first of which comprises chain wheels 12A mounted on a shaft 12B; one of the two transmission systems 10 and 12 is driving. Square supports 10C are connected to the chains 10B by suitable pins 10X. The square supports 10C support the pairs of rollers 10E intended to run in the respective track 15 and are fastened to a traverse 9F which forms part of the respective roll-holder 9. The roll-holders 9 have slits 9G which are spaced like the blades and parallel to the blades, so as to be aligned with the blades to allow the relative guiding between roll-holder 9 and blades 16 during the cutting along path 10A, and the penetration of the blades.

Figure 3:
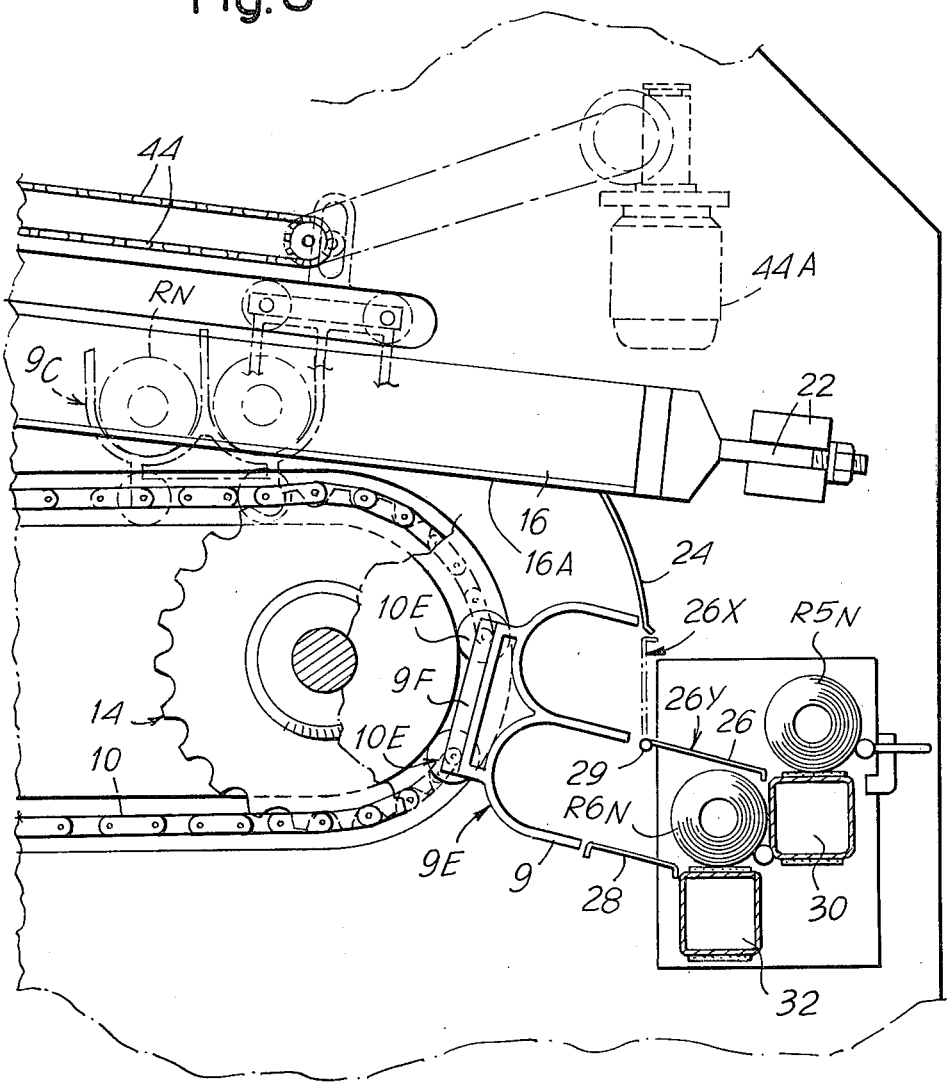
FIG. 3 illustrates an enlarged view of the right side of FIG. 1.
Figure 4:
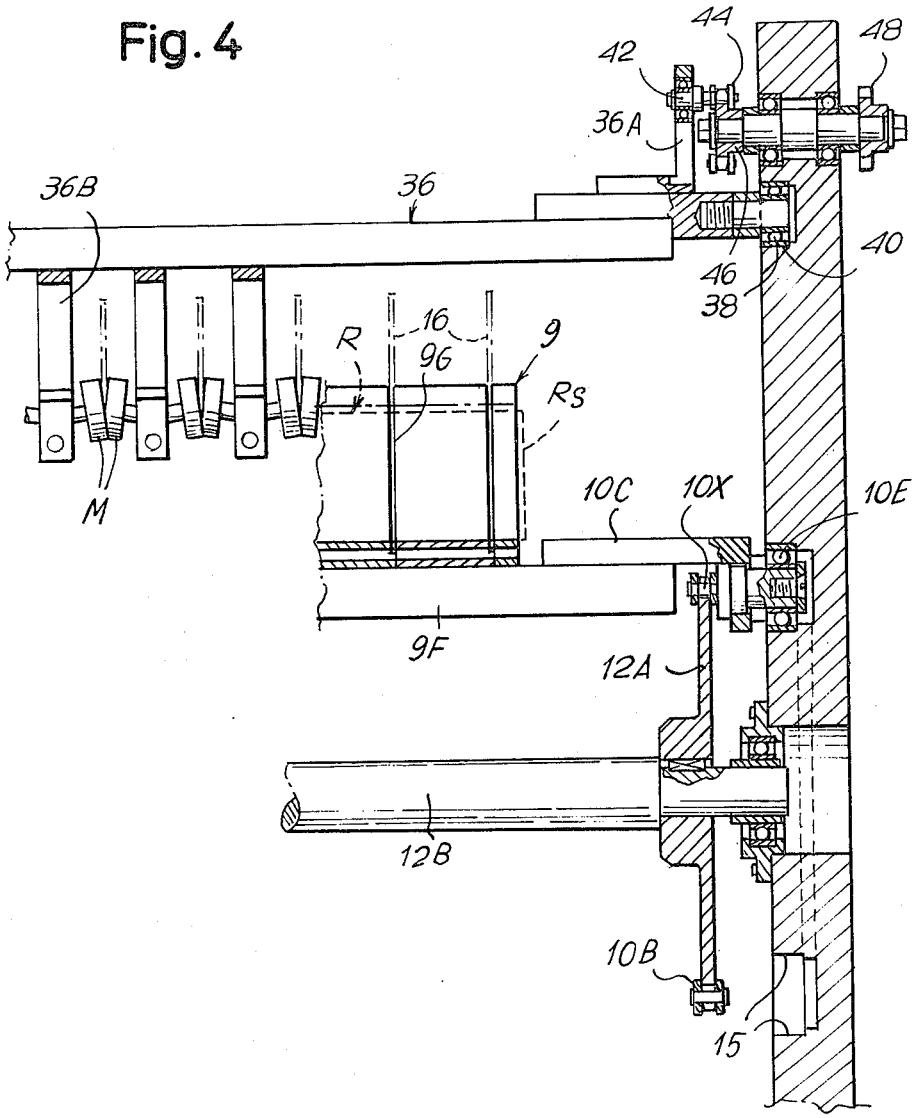
FIG. 4 is a transverse sectional view of FIG. 1.
Figure 5:
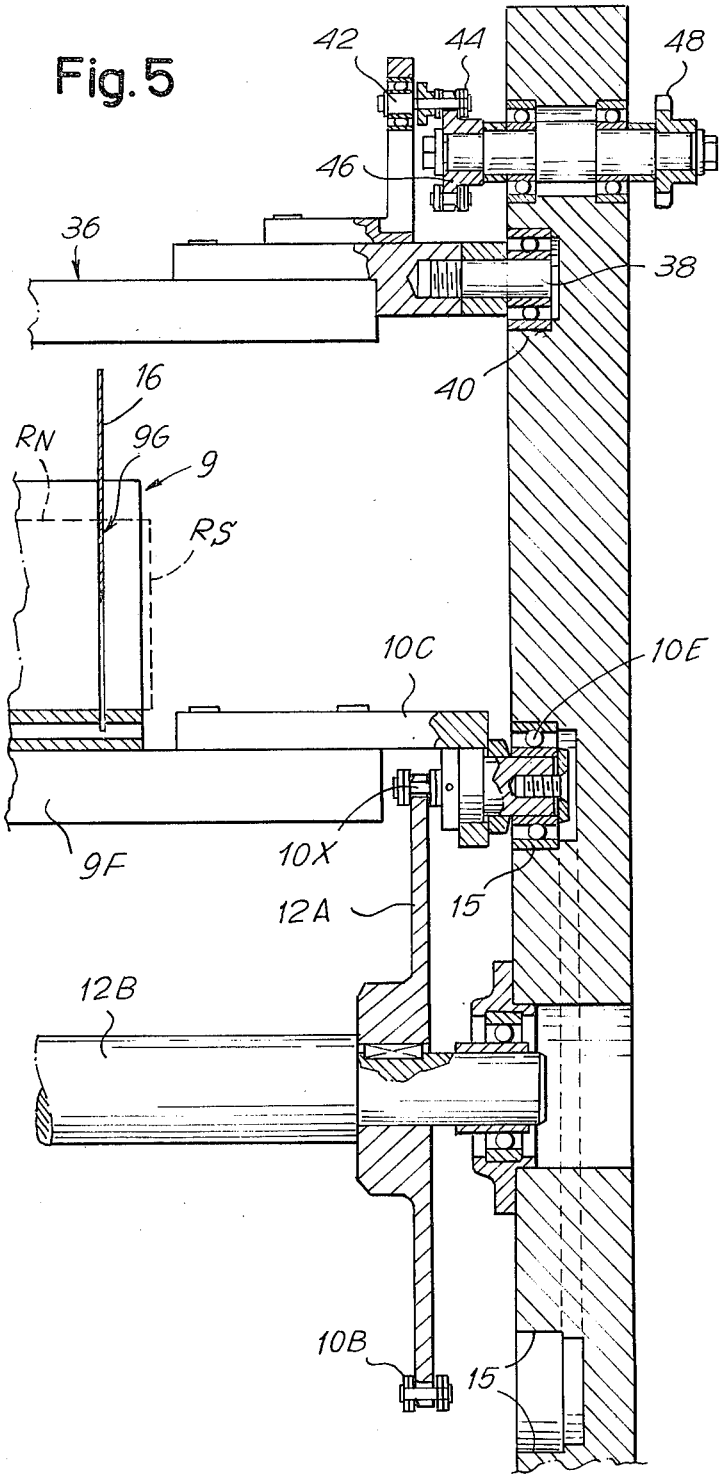
FIG. 5 is a transverse sectional view of FIG. 2.

The blades must be continuously sharpened and the sharpening can occur each time that a cut takes place. For the sharpening there is provided a grinding wheel-holding carriage 36, having rollers 38 at each of its ends guided in two straight guides 40, carried or formed by the flanks of the frame 18, for a rectilinear translation of the carriage 36. The carriage is driven through a roller pin 42 carried by a chain 44 driven parallel to the guides 40, there being advantageously provided two chains for two pins 42. In FIG. 3 there is illustrated one of the transmission wheels 46 of chain 44, which wheel 46 is driven externally by a drive 44A whose transmission comprises a toothed end wheel 48. The roller pins 42 engage in slots 36A of carriage 36, developed at right angles to the paths of the branches of chain 44 and hence to the guides 40. With this system the carriage 36 is driven at the right time in parallel translation to the blades and especially to the cutting edges 16A thereof. The drive of carriage 36 is actuated when a roll-holder 9 has traveled approximately half of the path between the initial position 9B and the final cutting position 9C. The motion of said carriage is relatively quick so as to obtain the total stroke along the blades and to complete it outward and back when element 9 reaches position 9E and stops there. After a complete cycle, the chains 44 stop and carriage 36 returns to the position shown in the drawing, adjacent to the ends of the blades 16 carried by the suppors 20. By 44A is indicated a reduction gear for the drive of the chains 44 of carriage 36. The slots 36A permit the relative excursion of the roller pins 42, with respect to carriage 36, so as to present supports 36B, on which are mounted opposite grinding wheels slightly inclined toward each other, so that pairs of grinding wheels M can act on the same blade with slightly inclined surfaces, to perform the continuous sharpening. The driving shafts M1 of the grinding wheels M are operable for with independent and continuous movement.

The inventive machine is of simple design and execution, of relatively low costs and of very high productivity, since with every cycle of the machine there is produced a twice number of small rolls obtainable from each roll or stick. Moreover, the end scraps of the sticks or rolls may be removed by regular cuts also made at the ends of the sticks. The cuts are made very regularly since of guiding the blades permits making them very thin. The overall space requirement of the machine is very small. The removal of the end scraps can occur by free fall, as these scraps hang over on the outside of the seats 9 and can be assisted in this fall and removal and conveyed into special collectors or recovery or recycle circuits. To facilitate the removal, the outermost slits can be very close to the ends of a trough type seat, and there can be provided air or suction jets to facilitate the lateral fall of the scraps.

The provision of the two removal conveyors 30, 32 allows for cutting in half the rate of flow of small rolls over two packaging or sorting circuits, with respect to the production of small rolls of the machine. One can also increase said removal conveyors in number, either by increasing the seats 9, or by providing deviators acting on the small rolls facing from one and the same seat, to send them alternately to two removal conveyors.

The drawing shows only an exemplification of the invention, which can vary in the forms and arrangements.

I claim:

1. A machine for transversely cutting elongated paper rolls into a plurality of cut paper rolls comprising means for transporting the rolls to be cut through a feedpath, a plurality of thin elongated cutting blades, each of said cutting blades having a cutting edge fixedly mounted in a plane parallel to and spaced from each other plane and overlying said feedpath, said feedpath and said cutting edge being disposed at an incline relative to each other, a roll holder mounted to said transporting means for movement therewith, said roll holder having two contiguous trough-shaped seats arranged normally to said feedpath and in each of which one of two elongated paper rolls to be cut simultaneously is placed, said seats having an arcuate seating surface conforming to the circumference of the elongated paper rolls to be cut, said seats having a plurality of slits at spaced intervals aligned with said cutting edges for guidingly receiving one of said cutting edges in one of said slits as the respective roll holder is transported through said feedpath, blade sharpening means mounted to each of said cutting blades for movement in parallel translation of the respective cutting edge thereof for sharpening said cutting edge, and means for driving said blade sharpening means in a reciprocating movement along the length of said cutting edge to continuously sharpen said cutting edge following the transport of said roll holder through said feedpath.

2. A machine as set forth in claim 1, wherein said roll holder comprises a plurality of said roll holders mounted to said transporting means at intervals along the length thereof for movement therewith.

3. A machine as set forth in claim 2, said transporting means comprises an endless track extending substantially beneath said feedpath.

4. A machine as set forth in claims 2 or 3, wherein said driving means is operable to drive said blade sharpening means in said reciprocating movement intermediate the transport of each of said roll holders through said feedpath.

5. A machine as set forth in claim 4, wherein said roll holder has a plurality of outermost slits close to the ends of the trough shaped seat to allow and facilitate the removal of scraps from the ends of said paper roll to be cut.

6. A machine as set forth in claim 4, further comprising at least two conveyors for the removal of the cut paper rolls, and each conveyor being operable to receive the cut paper rolls formed by one of said contiguous seats.

* * * * *